United States Patent [19]

Berndt et al.

[11] 4,273,979

[45] Jun. 16, 1981

[54] LOW-VOLTAGE CIRCUIT BREAKER WITH MEANS FOR LIMITING CONTACT LIFTING

[75] Inventors: Klaus-Günther Berndt; Manfred Krüger; Wolfgang Nawrot, all of Berlin, Fed. Rep. of Germany

[73] Assignee: Siemens Aktiengesellschaft, Berlin & Munich, Fed. Rep. of Germany

[21] Appl. No.: 29,025

[22] Filed: Apr. 11, 1979

[30] Foreign Application Priority Data

Apr. 19, 1978 [DE] Fed. Rep. of Germany ..... 2817668

[51] Int. Cl.[3] ..... H01H 3/60

[52] U.S. Cl. ..... 200/286; 200/153 G; 200/288

[58] Field of Search ..... 200/286, 288, 290, 153 G, 200/249, 251, 244; 335/15, 166

[56] References Cited

U.S. PATENT DOCUMENTS

| | | | |
|---|---|---|---|
| 3,258,572 | 6/1966 | Archer et al. | 200/244 |
| 3,366,756 | 1/1968 | Watson | 200/286 |
| 3,525,837 | 8/1976 | Leonard | 200/286 |
| 3,849,751 | 11/1974 | Link et al. | 200/153 G |

*Primary Examiner*—Willis Little

*Attorney, Agent, or Firm*—Kenyon & Kenyon

[57] ABSTRACT

A low-voltage circuit breaker has a fixed contact and a movable contact which is attached to a pivoted contact carrier. Between the contact carrier and the movable contact, a contact pressure spring is arranged, which is designed as a coil compression spring. The contact carrier has an arm which extends to the vicinity of the contact-making end of the movable contact. The arm carries a setscrew which is positioned to act centrally with respect to a contact overlay of the movable contact. The setscrew limits the lifting of the movable contact or the contact overlay to the desired small extent, when a large current flows through the circuit breaker and exerts electrodynamic force on the movable contact.

1 Claim, 2 Drawing Figures

LOW-VOLTAGE CIRCUIT BREAKER WITH MEANS FOR LIMITING CONTACT LIFTING

BACKGROUND OF THE INVENTION

1. Field of the Invention

This invention relates to a low-voltage circuit breaker having a fixed contact, a movable contact attached to a pivoted contact carrier as well as to a contact pressure spring arranged between the movable contact and the contact carrier, and having a device for limiting contact lifting.

2. Discussion of The Prior Art

A circuit breaker of this type is described, for instance, in U.S. Pat. No. 3,849,751. There, an additional spring with a stiff (steep) spring characteristic is arranged between the contact-making end of the movable contact and the contact carrier in order to limit lifting of the movable contact from its "on" position under the influence of electrodynamic forces. This leaf spring, however, interferes with the use of a conventional coil compression spring as the pressure spring between the movable contact and its contact carrier (U.S. Pat. No. 3,614,685). Therefore, a tension spring, attached to the end facing away from the contact point of the movable contact, is used as the contact pressure spring in this known circuit breaker.

It is an object of the invention to provide a circuit breaker of the type mentioned above which limits lifting of the movable contact from its "on" position under the influence of electrodynamic forces while permitting use of the compression spring as the contact pressure spring.

SUMMARY OF THE INVENTION

According to the present invention, this problem is solved by providing an adjustable stop on the contact carrier which limits lifting of the movable contact pressure spring from the "on" position against the force of the contact pressure spring. The space required by the stop is substantially less than that required by a leaf spring. The stop has the further advantage that lifting of the movable contact can be limited to an accurately defined extent which is independent of the current. Furthermore, in contrast to springs, the stop can, without difficulty, be made so that it is not affected or changed by the heat of an arc during switching processes.

The stop can be realized as a setscrew. In this manner, a permissible or desired lifting of the movable contacts can be adjusted accurately when the circuit breaker is installed.

This setscrew is placed so as to act centrally with respect to a contact overlay provided at the contact carrier. With this arrangement, the lifting forces are completely taken up by the setscrew and are transmitted to the contact carrier. Tilting or other movements of the movable contact relative to the contact carrier are therefore prevented.

DETAILED DESCRIPTION OF THE INVENTION

Figure 1:
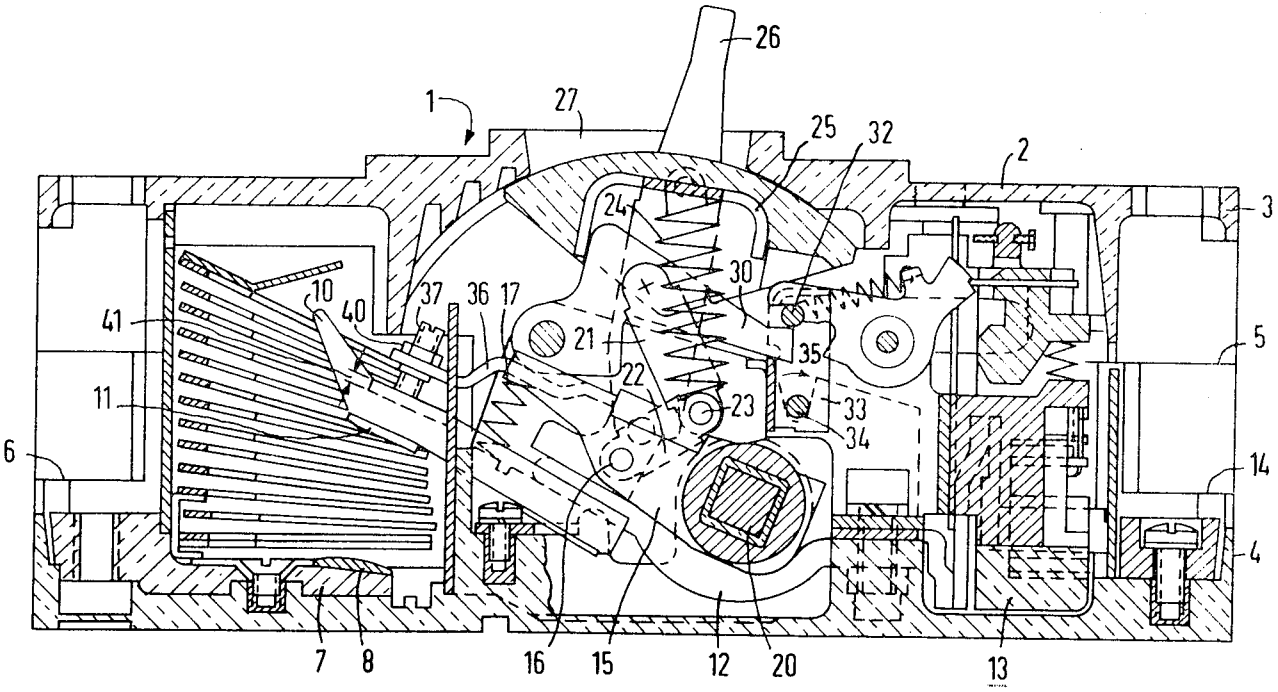
FIG. 1 is a longitudinal view, in cross section, of a low-voltage circuit breaker having an insulated housing with the breaker in the "off" position.

As shown in FIG. 1, circuit breaker 1 has a housing of an insulating material 2, and can be made, for instance, of molded plastic. The housing includes a lower part 4 on which an upper part 3 rests along a parting plane 5. The current in circuit breaker 1 flows along a path starting at connecting device 6, via a fixed contact 7, which has a contact overlay 8, and then, via a movable contact 10 having a contact overlay 11 and a flexible conductor ribbon 12, through a tripping device block 13, to a further connecting device 14. Movable contact 10 is pivoted and held on carrier 15 by means of a hinge-pin 16. A coil compression spring 17 is arranged between contact carrier 15 and movable contact 10, and serves as a contact pressure spring.

The assembly consisting of movable contact 10 and contact carrier 15 is fastened on a control shaft 20, on which the contact carriers for the movable contact of other pole channels are also attached in adjacent chambers of insulating housing 2. Toggle levers 21 and 22 are provided for moving each contact carrier and its movable contact, the toggle joint pin 23 serving as a point of attachment for a tension spring 24 which also abuts against the upper end of an actuating lever 25, tiltably supported in the insulating housing 2. An operating handle 26, made of insulating material, is placed on this actuating lever, and protrudes through an opening 27 in the upper part of insulating housing 2. Toggle lever 22 also engages hinge pin 16 which connects contact carrier 15 with movable contact 10. The other toggle lever 21 is braced against a main pawl 30, which is pivoted about a joint pin 31 and is braced, at its other end, against a locking member 32 in the latched condition of the breaker.

When switching circuit breaker 1 on and off by means of operating handle 26, tension spring 24 changes its direction of action with respect to toggle levers 21 and 22 in such a way that the toggle levers can be transferred into the stretched-out or the bent position. In FIG. 1, the toggle levers are shown as "bent," and the movable contact 10 is in the "off" position. Upon automatic triggering, trigger block 13 causes a carrier 33 to swing about a fulcrum 34 in the direction of arrow 35, causing the locking member 32 to be pulled away from main pawl 30. This cancels the support for toggle levers 21 and 22, so that contact carrier 15 and its movable contact 10 are likewise moved into the "off" position shown.

Figure 2:
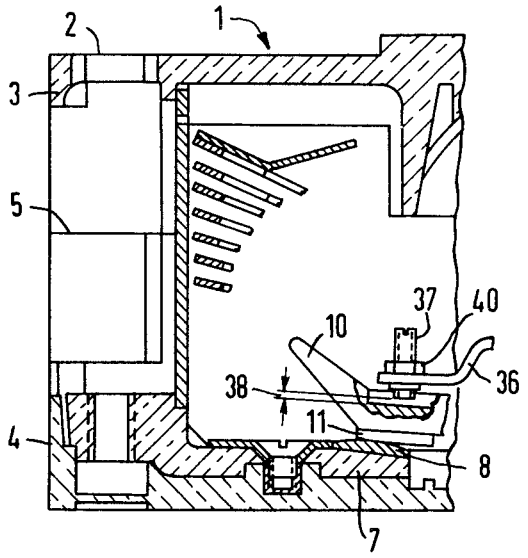
FIG. 2 shows the contact system of the circuit breaker of FIG. 1 in the "on" condition.

Contact carrier 15 is provided with an arm 36 which extends to the vicinity of the end provided with the contact overlay 11 of the movable contact 10. A setscrew 37, is inserted into arm 36 whose position, relative to the movable contact 10, can be adjusted by a nut 40. In the "off" position, shown in FIG. 1, setscrew 37 is placed opposite movable contact 10 and spaced apart from it by a small distance 41. The axis of setscrew 37 goes approximately through the center of contact overlay 11. When circuit breaker 1 is switched on, the distance between the setscrew and the movable contact is reduced in the "on" position in accordance with the compression of contact pressure spring 17, as is shown in FIG. 2. There remains a certain spacing 38 which can be, for instance, of the order of one millimeter. Contact overlays 8 and 11 can therefore separate only by this distance if lifting forces are exerted on the contact system due to a very large current flowing through the current path of circuit breaker 1. Limiting the distance between the contact overlays to the small amount indicated is beneficial since only small contact wear occurs.

As the figures show, contact pressure spring 17 is located between the contact carrier 15 and movable contact 10 approximately in the middle between setscrew 37 and joint pin 16. Depending on the desired point of attack of the force, the contact pressure spring can be placed either closer to joint pin 16 or to contact overlay 11 and setscrew 37 as is appropriate.

What is claimed is:

1. A low voltage circuit breaker comprising:

a fixed contact;

a movable, pivoted contact carrier;

a movable contact, pivoted around a joint on the contact carrier and having a contact overlay;

a pressure spring between the movable contact carrier and the movable contact and tending to move the movable contact around the joint;

an arm extending from the contact carrier approximately to the contact-making end of the movable contact; and an adjustable stop for limiting lifting of the movable contact from the "on" position, the adjustable stop positioned on the arm to act centrally of the contact overlay;

the contact spring located next to the stop between the stop and the joint.

* * * * *